United States Patent [19]

Elmy

[11] 4,190,414

[45] Feb. 26, 1980

[54] FAIL-SAFE GAS FEED AND IGNITION SEQUENCE CONTROL APPARATUS AND METHOD FOR A GAS-FIRED APPLIANCE

[75] Inventor: Richard A. Elmy, Louisville, Ky.

[73] Assignee: W. M. Cissell Manufacturing Company, Louisville, Ky.

[21] Appl. No.: 897,183

[22] Filed: Apr. 17, 1978

[51] Int. Cl.[2] ..... F27D 19/00; F23N 5/00; F23N 5/20

[52] U.S. Cl. ..... 432/46; 431/6; 431/67; 431/71

[58] Field of Search ..... 431/2, 6, 66, 67, 69, 431/71, 46; 432/44

[56] References Cited

U.S. PATENT DOCUMENTS

| | | | |
|---|---|---|---|
| 2,954,080 | 9/1960 | Prouty et al. | 431/71 |
| 3,367,386 | 2/1968 | Thunander | 431/71 |
| 3,536,308 | 10/1970 | White | 432/44 |
| 3,806,308 | 4/1974 | Cahoe et al. | 431/66 X |
| 3,871,814 | 3/1975 | Das et al. | 431/66 |
| 4,019,853 | 4/1977 | Sears et al. | 431/67 |

*Primary Examiner*—Carroll B. Dority, Jr.
*Assistant Examiner*—Lee E. Barrett
*Attorney, Agent, or Firm*—Wood, Herron & Evans

[57] ABSTRACT

A fail-safe apparatus and method for controlling the sequence of gas feed and ignition, such as by an incandescent igniter, in a gas-fired appliance, such as a thermostatically controlled timer activated clothes dryer. When the appliance is activated by the timer, the control apparatus energizes the igniter and opens a gas valve only after the igniter is energized for a period that is sufficient to heat the igniter to the temperature required to kindle the gas. If the gas is ignited, the control apparatus holds the gas valve open so that the gas continues to burn. If, however, the gas is not ignited, the control apparatus inhibits any further attempt at gas feed and ignition. If a temporary electrical power outage occurs, if the gas supply is interrupted, if the thermostat cycles on and off, or, in the case of a clothes dryer, if a loading/unloading door is opened and then shut again, the control apparatus repeats the gas feed and ignition sequence in an attempt to rekindle the gas.

9 Claims, 1 Drawing Figure

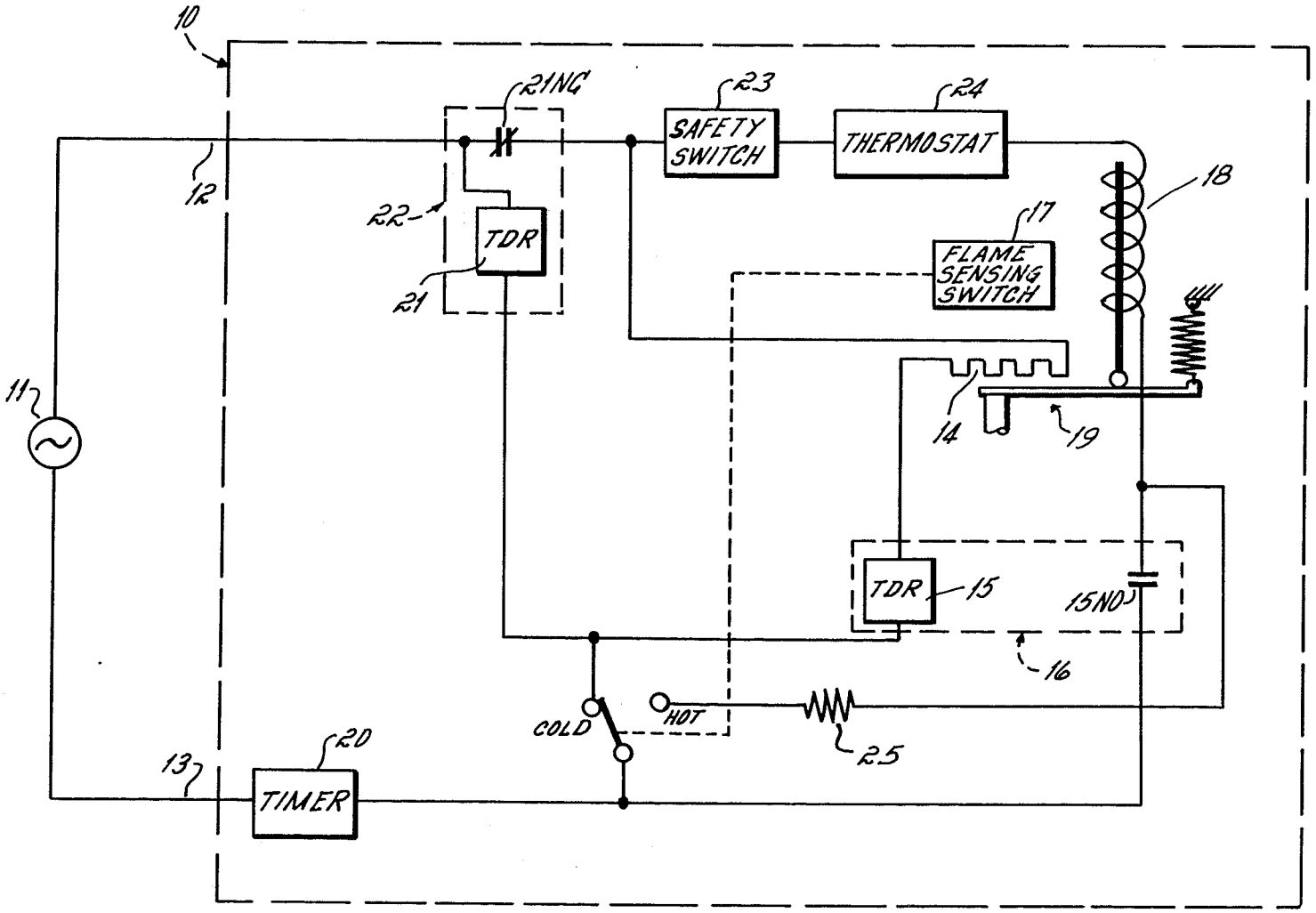
THERMOSTAT
24
SAFETY SWITCH
23
FLAME SENSING SWITCH
17
18
19
14
15NO
16
TDR
15
25
HOT
COLD
21NC
TDR
21
22
TIMER
20
10
12
13
11

FAIL-SAFE GAS FEED AND IGNITION SEQUENCE CONTROL APPARATUS AND METHOD FOR A GAS-FIRED APPLIANCE

BACKGROUND OF THE INVENTION

This invention relates to combustion control. More particularly, this invention relates to a fail-safe gas feed and ignition sequence control apparatus and method for controlling combustion in a gas-fired appliance, such as a clothes dryer.

The prior art discloses many different forms of combustion control apparatus and methods for controlling the feed of fuel, generally, fuel oil or natural gas, and ignition of the fuel in appliances such as furnaces, water heaters, cooking ovens, clothes dryers, etc. In some instances, the temperature of the environment heated by the appliance is controlled by a thermostat. In other instances, as in the case of cooking ovens and clothes dryers, the appliance is activated by a timer.

Much of the prior art relates to combustion control apparatus of a type which includes a pilot burner for igniting fuel fed to a main burner when heat is demanded. Such type was developed when fuel was plentiful as well as cheap and energy waste was tolerable. Furthermore, electrical igniters, such as spark igniters and incandescent igniters, had not been developed to the point where they were reliable and had a long life expectancy.

Since the advent of the spark igniter and the incandescent igniter, such as the silicon carbide igniter, having reliability and long life expectancy, a shift toward a type of combustion control apparatus which includes an electrical igniter has become evident in the prior art. The shift has received added emphasis in view of fuel shortages as well as the increased expense of fuel which makes energy waste intolerable.

Of the electrical igniters, the incandescent igniter has the advantage that the circuitry which comprises the combustion control apparatus is simpler and cheaper. This is because the incandescent igniter does not require a generator means for triggering sparks required for a spark igniter but only requires a means to electrically heat the incandescent igniter.

Although the prior art mentions various safety problems and in some instances provides combustion control apparatus which to some degree is fail-safe, prior art combustion control apparatus of the type which includes an incandescent igniter by and large is not fail-safe. For example, if the incandescent igniter were defective or if the fuel were to fail to ignite, a valve would nevertheless feed fuel so as to cause the danger of fire or explosion. Furthermore, if a temporary electrical power outage were to occur or if the fuel supply were interrupted, extinguishment of the ignited fuel would occur, but fuel would again feed through the valve on restoration of the electrical power or fuel supply so as to cause the danger of fire or explosion. Additionally, in some applications where a thermostat controls temperature or where there is a safety means, such as a loading/unloading door safety switch for a clothes dryer which assures that fuel is not ignited when the door is open, the danger of fire or explosion similarly exists when the thermostat cycles on and off or the safety means is actuated and then deactuated again.

SUMMARY OF THE INVENTION

Accordingly, one objective of this invention is to provide a combustion control apparatus and method for controlling the sequence for gas feed and ignition by an incandescent igniter, such as a silicon carbide igniter, which is reliable and has a long life expectancy. Another objective is to provide apparatus of such type which is fail-safe. A further objective is to provide a fail-safe apparatus which is thermostatically controlled. An additional objective is to provide a fail-safe apparatus for a thermostatically controlled timer activated clothes dryer having a safety means associated with the loading/unloading door.

In accordance with a preferred embodiment of this invention, a fail-safe combustion control apparatus is provided which comprises circuitry that includes an incandescent igniter, a gas feed time delay switch means, a solenoid means for controlling a gas valve, a holding resistor, a flame sensing means and a time delay lockout switch means connected in circuit with the power leads of an electrical power source. A timer, a thermostat and/or, in the case of a clothes dryer, a safety means, such as a loading/unloading door safety switch, are preferably connected between the combustion control apparatus and the power source to selectively control the supply of electrical power to the circuitry which comprises the combustion control apparatus.

The igniter, the operator of the gas feed time delay switch means and the cold contact of the flame sensing means are connected in series across the power leads. The solenoid means for controlling the gas valve is connected in series with a normally open contact of the gas feed time delay switch means across the power leads. When the power source is selectively connected to the power leads, preferably through the timer, the igniter is energized.

When the igniter has been energized for a period that is sufficient to heat the igniter to the temperature required to kindle the gas, the operator of the gas feed time delay switch means closes the normally open contact to connect the solenoid means directly across the power leads. Consequently, the solenoid means opens the gas valve so that gas flows over the igniter.

If the gas is not kindled, the operator of the time delay lockout switch means, which is connected in series with the cold contact of the flame sensing means across the power leads, opens a normally closed contact to isolate the igniter and the solenoid means from the power source. Consequently, the timer must time out before the time delay lockout switch means is de-energized. In the case of a clothes dryer, damp clothes found inside at the end of the timed drying period indicate a malfunction. As a result, fail-safe operation results if the gas is not kindled for any reason.

If the gas is kindled, the flame sensing means is actuated so that the cold contact is opened and a hot contact of the flame sensing means is closed. Consequently, the solenoid means is connected in series with the holding resistor and the hot contact across the power leads. As a result, the solenoid means is energized to hold the gas valve open even after the normally open contact of the gas feed time delay switch means is reopened due to de-energization of the operator of the gas feed time delay switch means after the cold contact is opened.

Whereas direct energization of the solenoid means through the normally open contact of the gas feed time delay switch means opens the gas valve, energization of the solenoid means through the hot contact of the flame sensing means and the holding resistor merely holds the gas valve open. Consequently, if a temporary electrical power outage occurs and the gas valve closes but the hot contact remains closed when electrical power is restored, the resultant energization of the solenoid means through the holding resistor is insufficient to open the valve. As a result, fail-safe operation results if a temporary power outage occurs so that the entire gas feed and ignition sequence must be repeated, as will happen once the cold contact of the flame sensing means is again closed. In the case of an applicant having a thermostat and/or, in the case of a clothes dryer, a loading/unloading door safety switch, analogous fail-safe operation takes place whenever the thermostat cycles on and off and/or the loading/unloading door is opened and then shut again.

Even if the source of gas is temporarily interrupted and the flame is extinguished, the hot contact of the flame sensing means is opened to de-energize the solenoid means. Consequently, the entire gas feed and ignition sequence must be repeated, as will happen once the cold contact of the flame sensing means is again closed.

The combustion control apparatus and method in accordance with the preferred embodiment of this invention advantageously has fail-safe operation so that the danger of fire or explosion is eliminated. Notwithstanding this advantage, the preferred embodiment is simple to construct and economical and yet is reliable and has a long life expectancy. The preferred embodiment has been found particularly advantageous when incorporated in a gas-fired clothes dryer, but application in appliances, particularly thermostatically controlled and/or timer activated appliances such as furnaces, cooking ovens, etc., would also have advantages.

BRIEF DESCRIPTION OF THE DRAWING

This invention will be better understood and its concomitant advantages will become clear to those skilled in the art through a consideration of the drawing in conjunction with the description which follows. The single FIGURE of the drawing is a schematic circuit diagram of a preferred embodiment for the fail-safe combustion control apparatus of this invention.

DESCRIPTION

The gas feed and ignition sequence control circuitry of the preferred embodiment for the fail-safe combustion control apparatus of this invention, designated generally by the numeral 10, is connected to a source of electrical power 11 through two power leads 12 and 13. The power source is preferably a readily available domestic alternating current power supply.

An incandescent igniter 14, such as a silicon carbide igniter, is connected in series with the operator 15 of a gas feed time delay switch means 16, such as an electrical time delay relay or a thermal time delay relay. The series-connected igniter 14 and operator 15 are connected across the power leads 12 and 13 when the cold contact of a flame sensing means 17, such as a Harper-Wyman Co. single-pole, double-throw flame switch #6313, is closed. Furthermore, a solenoid means 18 for controlling a gas valve 19, which is shown schematically, is connected in series with a normally open contact 15NO of the gas feed time delay switch means 16 across the power leads 12 and 13.

When the power source 11 is connected to the power leads 12 and 13, preferably through a timer 20, which is shown schematically, the igniter 14 is energized through a circuit including the power lead 12, the normally closed contact 21NC of a time delay lockout switch means 22, which will be described later, the igniter 14, the operator 15 of the gas feed time delay switch means 16, the cold contact of the flame sensing means 17, the timer 20 and the power lead 13. When the igniter 14 has been energized for a period that is sufficient to heat the igniter to the temperature required to kindle the gas, that is, to about 1800° F., the negative thermal characteristic of the igniter 14 allows the operator 15 of the gas feed time delay switch means 16 to be energized sufficiently to close the normally open contact 15NO.

When the operator 15 of the gas feed time delay switch means 16 closes the normally open contact 15NO, the solenoid means 18 is energized through a circuit including the power lead 12, the normally closed contact 21NC of the time delay lockout switch means 22, the solenoid means 18, the normally open contact 15NO of the gas feed time delay switch means 16, the timer 20 and the power lead 13. Consequently, the gas valve 19 is opened to feed gas over the igniter 14 when the solenoid means 18 is energized upon closure of the normally open contact 15NO of the gas feed time delay switch means 16.

Preferably, a thermostat 24 is also included in the circuit through which the solenoid means 18 is energized. In the case of a clothes dryer, a safety means 23, such as a loading/unloading door safety switch, is additionally connected in the energizing circuit for the solenoid means 18.

If the gas is not kindled, the cold contact of the flame sensing means 17 remains closed. Consequently, the operator 21 of the time delay lockout switch means 22 is energized through a circuit including the power lead 12, the operator 21 of the time delay lockout switch means 22, the cold contact of the flame sensing means 17, the timer 20 and the power lead 13. The time delay lockout means 22 may comprise an electrical time delay relay or a thermal time delay relay with a 60-second time delay, for example. If the flame sensing means 17 fails to detect ignition of the gas so that the cold contact of the flame sensing means 17 remains closed, the operator 21 of the time delay lockout switch means 22 opens the normally closed contact 21NC.

When the normally closed contact 21NC of the time delay lockout switch means 22 is opened, the solenoid means 18 is deenergized. Consequently, the gas valve 19 closes.

The operator 21 of the time delay lockout switch means 22 continues to be energized through a holding circuit including the power lead 12, the operator 21 of the time delay lockout switch means 22, the cold contact of the flame sensing means 17, the timer 20 and the power lead 13. Consequently, the time delay lockout switch means 22 provides a fail-safe if the gas is not kindled for any reason, such as if the igniter 14 is defective, the flame sensing means 17 is inoperative, the gas fails to ignite for any reason or the gas supply is cut off. The timer 20 must time out before the time delay lockout switch means 22 is deenergized. In the case of a clothes dryer, damp clothes found inside at the end of the timed drying period indicate a malfunction.

If the gas is kindled, the flame sensing means 17 is actuated so that the cold contact is opened and a hot contact of the flame sensing means 17 is closed. Although the operator 15 of the gas feed time delay switch means 16 is de-energized when the cold contact is opened, the gas feed time delay switch means 16 is of the slow-to-release type, so that the normally open contact 15NO does not open until such time as the hot contact of the flame sensing means 17 has already closed. Consequently, the solenoid means 18 is energized through a holding circuit including the power lead 12, the normally closed contact 21NC of the time delay lockout switch means 22, the loading/unloading door safety switch 23, the thermostat 24, the solenoid means 18, a holding resistor 25, the hot contact of the flame sensing means 17, the timer 20 and the power lead 13 before the normally open contact 15NO is opened.

As shown in the drawing, when the cold contact of the flame sensing means 17 is opened, the igniter 14 and the operator 21 of the time delay lockout switch means 22 are also de-energized. This extends the life expectancy of the igniter 14 and, of course, prevents the time delay lockout switch means 22 from inhibiting further operation of the igniter 14 and the solenoid means 18.

Energization of the solenoid means 18 through the holding circuit is sufficient to maintain the gas valve 19 open but is not sufficient to open the gas valve 19. This provides a fail-safe in the event a temporary electrical power outage occurs, the thermostat 24 cycles on and off or, in the case of a clothes dryer, the loading/unloading door safety switch 23 is actuated and then deactuated again.

Specifically, if a temporary electrical power outage occurs, the solenoid means 18 is de-energized so that the gas valve 19 closes and the flame is automatically extinguished. Furthermore, if the thermostat 24 switches on and then off again, the holding circuit for the solenoid means 18 is opened. Similarly, if the loading/unloading door is opened and then shut again, the holding circuit for the solenoid means 18 is opened. In the event that the thermostat 24 cycles on and then off again or the loading/unloading door safety switch is actuated and then deactuated again, so that the holding circuit for the solenoid means 18 is opened, the solenoid means 18 is de-energized so that the gas valve 19 closes and the flame is extinguished.

If the electrical power is restored, the thermostat cycles on again or the loading/unloading door is shut again before the hot contact of the flame sensing means 17 is reopened, the re-established energization of the solenoid means 18 through the holding circuit is insufficient to open the gas valve 19. This prevents the feed of gas, since the gas might not be rekindled.

If the timer 20 has not timed out, however, because electrical power outage, thermostatic control or opening of the loading/unloading door causes the cold contact of the flame sensing means 17 to be closed due to extinguishment of the flame, the igniter 14 and the operators 15 and 21 of the respective gas feed time delay switch means 16 and time delay lockout switch means 22 are again energized. Consequently, recycling is initiated, and the above-described gas feed and ignition sequence is repeated in an attempt to rekindle the flame.

Even if the gas supply is temporarily interrupted so that the flame is extinguished, the hot contact of the flame sensing means is reopened. Consequently, the holding circuit for the solenoid means 18 is opened so that the solenoid means 18 is de-energized and the gas valve 19 closes. As a result, however, if the timer 20 has not timed out, because interruption of the gas supply causes the cold contact of the flame sensing means 17 to be closed due to extinguishment of the flame, the igniter 14 and the operators 15 and 21 of the respective gas feed time delay switch means 16 and time delay lockout switch means 22 are again energized. Consequently, recycling is initiated, and the above-described gas feed and ignition sequence is repeated in an attempt to rekindle the flame.

The combustion control apparatus in accordance with the preferred embodiment of this invention advantageously has fail-safe operation in the event of failure to ignite the gas for any reason, an electrical power outage, interruption of the gas supply, cycling of a thermostat and/or, in the case of a clothes dryer, opening of the loading/unloading door. This eliminates the danger of fire or explosion. Notwithstanding this advantage, the preferred embodiment is simple in construction and economical. Due to the incorporation of an incandescent igniter, the preferred embodiment is reliable and has a long life expectancy.

Although the preferred embodiment is energized by an alternating current power supply, the circuitry could be readily modified for energization by a direct current power supply by substituting direct current switch means, such as electronic switches, for the gas feed time delay switch means 16 and the time delay lockout switch means 22 and a direct current solenoid means for the solenoid means 18. These and other modifications will become apparent to those of skill in the art without departing from the scope of this invention.

The preferred embodiment has been found particularly advantageous when incorporated in a gas-fired clothes dryer and has been described in connection with such an application. Nevertheless, application in other appliances, particularly thermostatically controlled and/or timer activated appliances such as furnaces and cooking ovens, would provide similar advantages as will be apparent to those of skill in the art.

Having described my invention, I claim:

1. A fail-safe combustion control apparatus for controlling the gas feed and ignition sequence in a gas-fired appliance, comprising circuitry including:

power leads selectively connected to an external source of electrical power;

an incandescent igniter for kindling gas to provide a flame;

a gas feed time delay switch means having an operator and a normally open contact;

a flame sensing means having a cold contact and a hot contact for detecting said flame;

a time delay lockout switch means having an operator and a normally closed contact;

said incandescent igniter, said gas feed time delay switch means operator, said normally closed contact of said time delay lockout switch means and said cold contact being connected in series across said power leads;

a solenoid means for controlling a gas valve;

said solenoid means, said normally closed contact of said time delay lockout switch means and said normally open contact of said gas feed time delay switch means being connected in series across said power leads;

said time delay lockout switch means operator and said cold contact being connected in series across said power leads; and a holding resistor;

said holding resistor, said hot contact, said solenoid means and said normally closed contact of said time delay lockout switch means being connected in series across said power leads.

2. The fail-safe combustion control apparatus of claim 1 further including:

a timer for selectively connecting said external source of electrical power to said power leads.

3. The fail-safe combustion control apparatus of claim 1 further including:

a thermostat, said thermostat being connected in series with said series-connected normally closed contact of said time delay lockout switch means, solenoid means, holding resistor and hot contact across said power leads.

4. The fail-safe combustion control apparatus of claim 3 wherein said gas-fired appliance is a clothes dryer having a loading/unloading door and further including:

a loading/unloading door safety switch, said loading-/unloading door safety switch being connected in series with said series-connected thermostat, normally closed contact of said time delay lockout switch means, solenoid means, holding resistor and hot contact across said power leads.

5. A method for controlling the gas feed and ignition sequence in a gas-fired appliance having a combustion control apparatus comprising circuitry including an electrical igniter, a gas feed time delay switch means, a solenoid means for controlling a gas valve, a holding resistor, a flame sensing means and a time delay lockout switch means connected in circuit with power leads of an electrical power source selectively connected to the power leads, including the steps of:

selectively connecting the electrical power source to the power leads;

energizing the igniter, the gas feed time delay switch means and the time delay lockout switch means when the flame sensing means detects that no flame is present;

energizing the solenoid means under control of the gas feed time delay switch means when the igniter heats to a temperature required to kindle the gas, thereby opening the gas valve so that gas feeds over the igniter;

inhibiting further operation of the igniter and the solenoid means under control of the time delay lockout switch means if the flame sensing means fails to detect kindling of a flame, thereby providing fail-safe operation if the gas is not kindled;

energizing the solenoid means only through the resistor under control of the flame sensing means when a flame is detected so that the gas valve is held open;

de-energizing the time delay lockout switch means under control of the flame sensing means when a flame is detected;

de-energizing the solenoid means so as to close the gas valve under control of the holding resistor when the electrical power source fails, thereby providing fail-safe operation if a temporary electrical power outage occurs; and de-energizing the solenoid means so as to close the gas valve under control of the flame sensing means when the gas supply is interrupted, thereby providing fail-safe operation if the gas supply is temporarily interrupted.

6. The method of claim 5 further including the step of:

re-initiating the gas feed and ignition sequence under control of the flame sensing means in the event of fail-safe operation except due to failure to kindle a flame.

7. The method of claim 5 or 6 wherein the circuitry further includes a timer and the timer selectively connects the electrical power source to the power leads.

8. The method of claim 5 or 6 wherein the circuitry further includes a thermostat, further including the step of:

de-energizing the solenoid means so as to close the gas valve under control of the thermostat, thereby providing fail-safe operation whenever the desired temperature of the environment heated by the gas-fired appliance is reached.

9. The method of claim 5 or 6 wherein the gas-fired appliance is a clothes dryer having a loading/unloading door and wherein the circuitry further includes a loading/unloading door safety switch, further including the step of:

de-energizing the solenoid means so as to close the gas valve under control of the loading/unloading safety switch, thereby providing fail-safe operation whenever the loading/unloading door is opened.

* * * * *